US010493654B2

(12) United States Patent
Gehrer et al.

(10) Patent No.: US 10,493,654 B2
(45) Date of Patent: Dec. 3, 2019

(54) DEVICE AND METHOD FOR THE GLUING OF PARTICLES

(71) Applicant: Brav-O-Tech GmbH, Duisburg (DE)

(72) Inventors: Udo Gehrer, Wuerselen (DE); Johannes Hicker, Duisburg (DE); Roland Hicker, Bochum (DE)

(73) Assignee: Brav-O-Tech GmbH, Duisburg (DE)

( * ) Notice: Subject to any disclaimer, the term of this patent is extended or adjusted under 35 U.S.C. 154(b) by 224 days.

(21) Appl. No.: 15/546,931

(22) PCT Filed: Jan. 11, 2016

(86) PCT No.: PCT/EP2016/050350
§ 371 (c)(1),
(2) Date: Jul. 27, 2017

(87) PCT Pub. No.: WO2016/120046
PCT Pub. Date: Aug. 4, 2016

(65) Prior Publication Data

US 2018/0009127 A1 Jan. 11, 2018

(30) Foreign Application Priority Data

Jan. 28, 2015 (DE) ..... 10 2015 201 464

(51) Int. Cl.
*B27N 1/02* (2006.01)
*B27N 3/02* (2006.01)

(52) U.S. Cl.
CPC ..... *B27N 1/0263* (2013.01); *B27N 1/029* (2013.01); *B27N 3/02* (2013.01)

(58) Field of Classification Search
None
See application file for complete search history.

(56) References Cited

U.S. PATENT DOCUMENTS 4,478,896 A * 10/1984 Barnes ..... B27N 1/0263 118/303
5,064,689 A * 11/1991 Young, Sr. ..... B27N 1/00 156/62.2
5,188,785 A * 2/1993 Bauer ..... B01F 3/0807 264/109
5,792,264 A * 8/1998 Frati ..... B27N 1/02 118/303
2007/0001350 A1 1/2007 Schneider
(Continued)

FOREIGN PATENT DOCUMENTS

CH 628521 A5 3/1982
DE 2438818 A1 2/1976
(Continued)

OTHER PUBLICATIONS

English translation of WO 2014/180867.*

*Primary Examiner* — Mary Lynn F Theisen
(74) *Attorney, Agent, or Firm* — The Webb Law Firm

(57) ABSTRACT

The invention relates to a device for the gluing of particles, in particular wood particles, including a dryer and a line transporting the stream of particles, wherein the stream of particles is being introduced in a main flow direction into the dryer via the outlet. A binder is supplied to the stream of particles, said binder being introduced via a nozzle device with a speed component directed against the main flow direction.

11 Claims, 2 Drawing Sheets

(56) References Cited

U.S. PATENT DOCUMENTS

| | | | | |
|---|---|---|---|---|
| 2013/0175727 | A1* | 7/2013 | Brancuzsk ..... | B27N 1/02<br>264/109 |
| 2013/0276951 | A1 | 10/2013 | Speidel | |

FOREIGN PATENT DOCUMENTS

| | | | |
|---|---|---|---|
| DE | 2653826 | A1 | 6/1977 |
| DE | 4122842 | A1 | 1/1993 |
| DE | 102006026124 | A1 | 12/2007 |
| DE | 102008063914 | A1 | 6/2010 |
| EP | 2704884 | B1 | 1/2015 |
| WO | 0243934 | A1 | 6/2002 |
| WO | 2009116877 | A1 | 9/2009 |
| WO | 2012140206 | A1 | 10/2012 |
| WO | 2014180867 | A1 | 11/2014 |

* cited by examiner

DEVICE AND METHOD FOR THE GLUING OF PARTICLES

CROSS-REFERENCE TO RELATED APPLICATIONS

This application is the United States national phase of International Application No. PCT/EP2016/050350 filed Jan. 11, 2016, and claims priority to German Patent Application No. 10 2015 201 464.9 filed Jan. 28, 2015, the disclosures of which are hereby incorporated in their entirety by reference.

BACKGROUND OF THE INVENTION

Field of the Invention

The present invention relates to a device for gluing particles, in particular wood particles, such as wood fibers, comprising a dryer and a line transporting the stream of particles, wherein the stream of particles is introduced in a main flow direction into the dryer via the outlet, and wherein a binder is supplied to the stream of particles.

Description of Related Art

Such devices are known from the production of fiber boards, MDF boards, HDF boards, wooden composite boards or plastic material boards. The stream of particles is formed from a mixture of the particles with vapor and is fed into the dryer via the line carrying the stream of particles, the so-called blowline. DE 10 2008 063 914 A1 discloses such a device in which the binder is supplied to the stream of particles already in the line carrying the stream of particles. DE 10 2006 026 124 A1 and WO 2009/116877 A1 disclose embodiments in which the binder is supplied directly at the outlet of the blowline. Here, the outlet of the blowline forms a kind of mixing nozzle with which the particles are mixed with the binder supplied to the nozzle.

DE 41 22 842 A1 discloses a device in which the binder is sprayed from a nozzle onto the stream of particles leaving an outlet of the blowline.

In all known devices the binder is supplied in the main flow direction of the stream of particles, with the problem of achieving an advantageous distribution of the binder as it is supplied to the stream of particles.

An early supply of binder to the stream of particles has the effect that, in case of possible changes in the direction of the lines carrying the stream of particles, adhesions to pipe line walls may occur, whereby the pipe lines may become clogged by accretions.

Providing mixing nozzles for the binder and the stream of particles, as well as spraying the particles after their exit from the blowline outlet leads to a great device-related effort or leads to an irregular gluing of the particles.

Therefore, it is an object of the present invention to improve the known devices, while avoiding the above mentioned problems, and in particular to achieve an improved gluing of the particles. Further, it is an object of the present invention to provide a corresponding method.

SUMMARY OF THE INVENTION

In the device of the present invention for gluing particles, in particular wood particles such as wood fibers, comprising a dryer and a line carrying the stream of particles, the stream of particles being introduced into the dryer in a main flow direction via the outlet of the line, and wherein a binder is supplied to the stream of particles via a nozzle with a velocity component directed against the main flow direction. In other words: contrary to the teachings of prior art according to which the binder is supplied in the direction of the stream of particles, the invention provides that the binder is introduced into the stream of particles via the nozzle such that the binder has a velocity component directed against the main flow direction. The nozzle device is thus directed against the main flow direction and extends e.g. under an obtuse angle with respect to the main flow direction. It has shown that such a supply of the binder is particularly advantageous for the distribution of the binder, since the stream of particles consisting of the particles and vapor is conducted through the line at a high velocity and meets the binder introduced. The binder may be supplied in particular in a non-atomized state. Thus, the stream of particles collides with the binder introduced, whereby the binder is atomized in a fan-like manner. Owing to the fact that the binder is introduced with a velocity component directed against the main flow direction, it is achieved that, when the binder is entrained during atomization in a curve-shaped manner, while it is fanned out. A particularly advantageous distribution of the binder is created thereby, the binder at the same time penetrating relatively deep into the stream of particles.

Preferably it is provided that the nozzle device has at least one jet-forming nozzle. In other words: The nozzle of the nozzle device is not an atomizing nozzle, but forms a binder jet. This is advantageous in that, when the stream of particles collides with the binder, the binder is first atomized, wherein the impinging stream of particles entrains outer portions arranged on the side of the jet facing the stream of particles. Thus, it is achieved that the binder jet can penetrate very far into the stream of particles so that an advantageous distribution of the binder into the stream of particles can be achieved. Further, a jet-forming nozzle has a simple structure so that complicated nozzle geometries, as provided in prior art, are not required. Further, in a jet-forming nozzle, the risk of clogging caused by hardening binder is rather low so that the maintenance effort is reduced. Moreover, a jet-forming nozzle is energetically more favorable than an atomizing nozzle.

In this regard it may be provided that the nozzle device has two or three jet-forming nozzles arranged in parallel with each other. Thus, three liquid jets of binder can be produced that are distributed across the width of the stream of particles. In particular it may be provided that the jet-forming nozzles are arranged in a row and are spaced at equal distances from each other. By providing three jet-forming nozzles, it is possible to achieve a particularly advantageous distribution of binder in the stream of particles. In the context of the present invention, a parallel arrangement of the nozzles means that the directions of the nozzles, i.e. the direction of the binder jets leaving the nozzles, are parallel to each other.

As an alternative it may be provided that the nozzle openings of the two or three jet-forming nozzles do not extend in parallel with each other, but at an angle with respect to each other. A first, central nozzle may e.g. be directed to the centre line of the stream of particles, whereas the two other nozzles are each arranged under the same angle to the central nozzle. In particular, three nozzles may be arranged in a plane. Due to the angular arrangement, an improved distribution of the binder in the stream of particles may be achieved, since the binder is distributed very widely as it is introduced into the stream of particles, while at the same time the nozzle device has relatively small dimensions.

In a preferred embodiment of the invention it is provided that the at least one jet-forming nozzle of the nozzle device has an elongate cross section, e.g. an elliptic cross section. In this manner, it is possible to form a binder jet with a corresponding cross section. The orientation of such a nozzle may be transversal to the main flow direction so that the binder jet has a wider extension that is transversal to the main flow direction or in the main flow direction, so that the wider side of the binder jet extends in the main flow direction. The orientation of the nozzle transversal to the main flow direction may be advantageous, since the binder jet then has a relatively wide dimension in a direction transversal to the nozzle direction so that an advantageous distribution can be achieved in the stream of particles in a direction transversal to the nozzle direction. The orientation of the nozzle with the wider extension in the main flow direction has the particular advantage that the effective area of contact with the binder jet, formed between the stream of particles and the binder jet, is relatively small compared to the strength of the binder jet, so that at least a part of the binder jet maintains a jet shape over a long distance in the stream of particles before a complete atomization of the binder has occurred. Thereby, the binder jet can enter very deep into the stream of particles, thereby causing a particularly advantageous distribution.

With a nozzle device having two or more jet-forming nozzles, some or all of the nozzles may have such a nozzle shape.

In a particularly preferred embodiment of the invention it is provided that the nozzle device is arranged downstream of the outlet, seen in the main flow direction. In other words: the binder is introduced against the main flow direction in that portion of the stream of particles in which an expansion of the stream of particles already occurs. It has been found that in the line carrying the stream of particles, the pressure decreases towards the outlet. Further, an evaporation of residual humidity in the stream of particles occurs. Due to the pressure relief and the evaporation, the velocity of the stream of particles increases towards the outlet of the line, so that the same leaves the outlet of the line at a high velocity. By arranging the nozzle device downstream of the outlet in the main flow direction, the binder can be introduced into a part of the stream of particles where the velocity of the latter is very high, whereby the binder is atomized in a particularly advantageous manner when the stream of particles collides with the same.

It is preferably provided that the nozzle direction of the at least one nozzle of the nozzle device is arranged under an angle $\beta$ with respect to the main flow direction, where; $90° < \beta < 180°$. The angle $\beta$ may e.g. be between 120° and 150°, preferably 135°.

Preferably it is provided that the at least one nozzle of the nozzle device is oriented to the line of section of a centre plane of the stream of particles with the outlet plane of the outlet of the line. In case of a horizontal path of the line, the at least one nozzle is preferably directed to the line of section of the horizontal centre plane of the stream of particles with the vertical outlet plane of the outlet of the line. In other words: the nozzle direction of the nozzle or the nozzles is directed to the horizontal centre line of the outlet. Thereby, it is achieved that the binder introduced collides with the centre of the stream of particles approximately in the section of the stream of particles that has the highest velocity. Thus, a particularly advantageous distribution of the binder is achieved.

It may also be provided that the at least one nozzle is directed to a portion of the outlet plane of the outlet of the line that is on the side facing the nozzle. In case of a horizontal path of the line, the at least one nozzle is thus directed onto a portion of the outlet plane of the outlet above the horizontal centre line of the outlet. In other words: compared to the above described embodiment, in which the nozzle is directed to the horizontal centre line of the outlet, the nozzle direction has a larger angle $\beta$ with respect to the main flow direction. In this regard it may be provided that the binder jet is formed such that a complete deflection occurs when the jet has been introduced already upstream of the outlet plane of the outlet of the line, seen in the main flow direction. In other words: the binder jet partly penetrates into the line. Such an orientation of the binder jet has proven to be particularly advantageous. The binder jet may be oriented e.g. to a portion that extends from the centre line of the outlet for about a quarter of the outlet diameter.

The nozzle device may also be arranged at a section of the line arranged in the dryer, upstream of the outlet in the main flow direction. Thus, the binder may also already be introduced into the line and into the stream of particles against the main flow direction.

In a preferred embodiment of the invention it is provided that teach nozzle has a nozzle feed line, the nozzle feed line having a diameter D and, upstream of the nozzle outlet, a linear feed line section of a length L, where: $L/D > 1.5$. Thereby, it is achieved that, when being supplied, the binder fed to the nozzle settles e.g. due to a strongly deflected supply towards the nozzle outlet, so that a jet can be formed in an advantageous manner.

The invention further refers to a method for gluing particles, in particular wood particles, such as wood fibers, in a dryer, wherein a stream of particles is introduced into the dryer in a main flow direction, and wherein a binder is supplied to the stream of particles. The method of the present invention is characterized in that the binder is introduced with a velocity component directed opposite the main flow direction.

Here, it may be provided that the binder is introduced into the stream of particles as at least one liquid jet.

The advantages of introducing the binders opposite to the main flow direction of the stream of particles have already been described with regard to the device of the invention and apply analogously to the method of the invention.

In the method of the present invention it may further be provided that the binder is introduced at a pressure between 5 and 40 bar. In the context of the invention, the pressure at which the binder is introduced is the pressure immediately upstream of the nozzle. It has been found that introducing the binder at such a pressure causes the forming of a particularly advantageous liquid jet which results is a particularly advantageous distribution of the binder in the stream of particles.

It may be provided that the binder is introduced at a velocity of at least 50 m/s with a viscosity of the binder between 30 and 150 mPa·s. By means of such a high velocity of the binder it is ensured that the binder will penetrate relatively deep into the stream of particles and that a particularly advantageous atomization and distribution of the binder is achieved. Further, at a velocity that high, the velocity component directed against the main flow direction is relatively large, so that the binder and the stream of particles collide at an even higher relative velocity, whereby a higher kinetic energy is achieved for atomizing the binder.

The method of the present invention may be performed in a particularly advantageous manner using the device of the present invention.

In the method of the present invention it may in particular be provided that the binder is supplied to the stream of particles in the main flow direction after the introduction into the dryer. Here, the liquid jet of the binder may be directed in particular to the outlet of a line carrying the stream of particles. The liquid jet of the binder may be oriented under an angle β with respect to the main flow direction of the stream of particles, wherein the angle β preferably is between 120° and 150°, particularly preferred 135°.

The method of the present invention may further provide that, upon introduction of the stream of particles into the dryer, an annular flow is generated that surrounds the stream of particles and influences the expansion behavior of the stream of particles.

BRIEF DESCRIPTION OF THE DRAWINGS

The following is a detailed description of the invention with reference to the accompanying Figures.

In the Figures.

DETAILED DESCRIPTION

Figure 1:
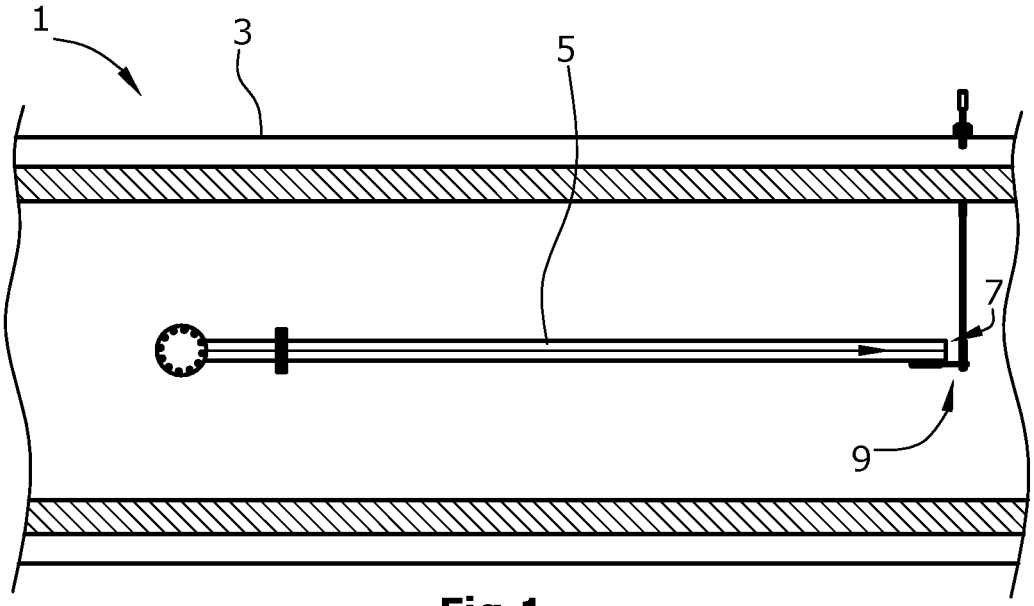
FIG. 1 is a schematical sectional view of the dryer of a device for gluing particles according to the present invention.

FIG. 1 schematically shows a section through a device 1 according to the present invention for gluing particles. The device comprises a dryer 3 into which a stream of particles of a particle/vapor mixture is introduced. The dryer 3 serves to dry the particles.

The stream of particles is introduced into the dryer 3 via a line 5 carrying the stream of particles. Here, the stream of particles has a man flow direction indicated by an arrow in FIG. 1. The stream of particles leaves the line 5 at an outlet 7. Downstream of the outlet 7, seen in the main flow direction, a binder is supplied to the stream of particles via a nozzle device 9.

Figure 2:
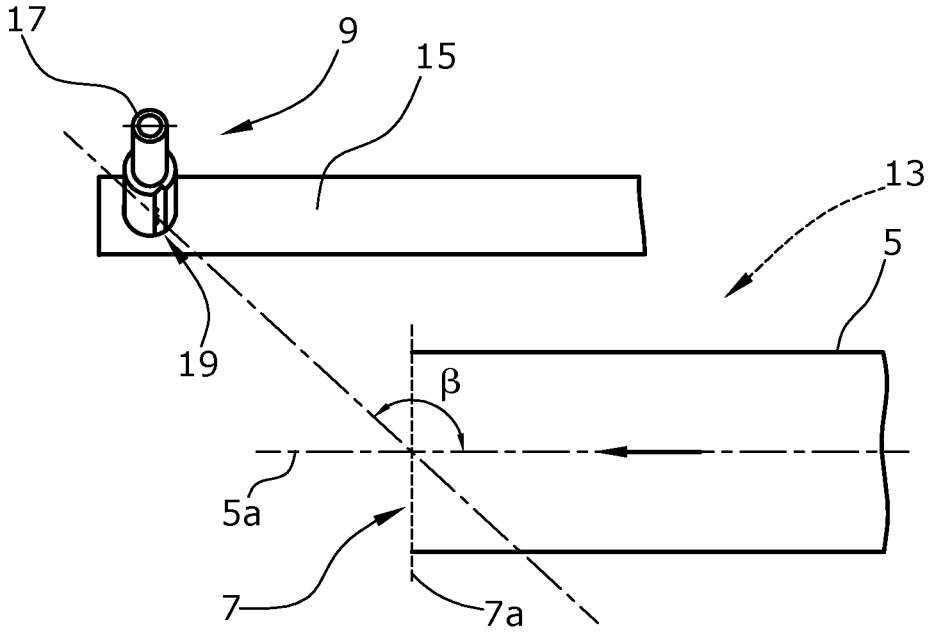
FIG. 2 is a schematical detail of the nozzle device and the outlet of the line of the stream of particles of a device for gluing particles according to the present invention.

FIG. 2 schematically shows a detail of the end of the line 5 forming the outlet 7. The stream of particles leaves the line 5, which is also referred to as a blowline, at a high velocity through the outlet 7. When leaving the line 5 through the outlet 7 and, thus, when entering the dryer 3, the stream of particles expands.

Figure 3:
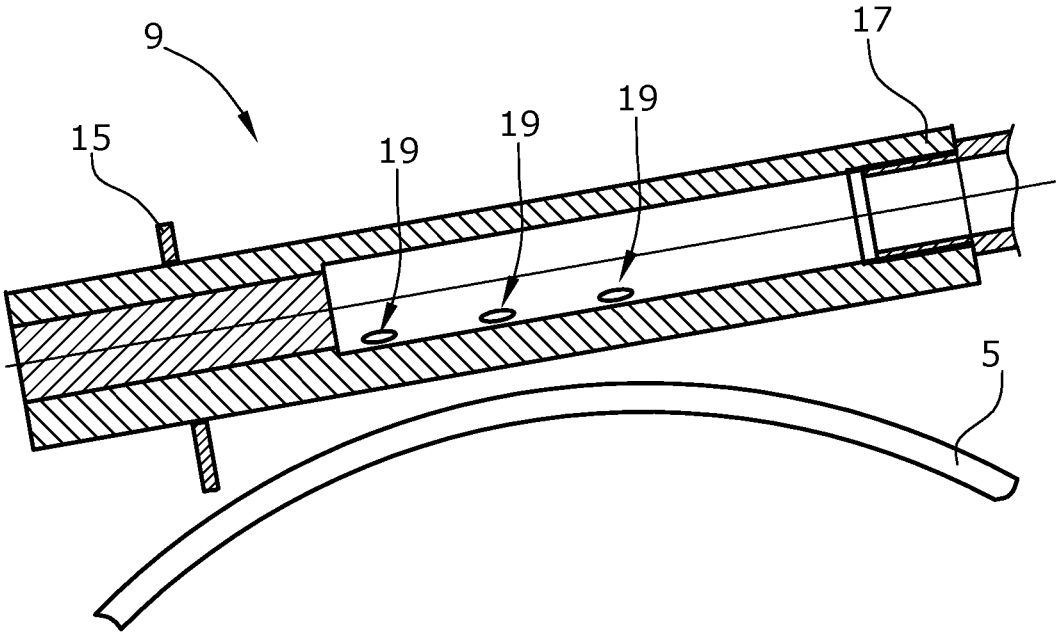
FIG. 3 is a schematical detail of the nozzle device of a device according to the present invention.

The nozzle device 9 is fastened by a schematically indicated mount 15. The nozzle device 9 is formed by a nozzle pipe 17 in which three parallel nozzles 19 are arranged, which are best seen in FIG. 3. The nozzles 19 are jet-forming nozzles so that liquid jets of binder can be produced by means of the nozzle device. The nozzles are oriented at an angle β relative to the main flow direction which is also indicated by an arrow in FIG. 2, i.e. the nozzle direction and thus the direction of the liquid jet leaving the nozzles extend at an angle β with respect to the main flow direction. In the embodiment illustrated in FIG. 2, the angle β is 135°.

Thus, the nozzles 19 of the nozzle device 9 produce binder jets having a velocity component directed against the main flow direction. Thereby, it is achieved that the stream of particles conveyed through the line 5 at a high velocity collides with the binder and atomizes the same very finely, whereby an advantageous gluing of the particles of the stream of particles is obtained.

The nozzles 19 may in particular be directed on the sectional line of the horizontal centre plane 5*a* of the stream of particles with the vertical outlet plane 7*a* of the outlet 7 of the line 5. In this manner, the binder impinges on the central portion of the stream of particles in approximately the outlet plane 7*a*, whereby an advantageous distribution of the binder is achieved.

As best seen in FIG. 3, the nozzles 19 are supplied with binder via the common nozzle pipe 17. The nozzle pipe 17 extends under an acute angle with respect to the horizontal plane, e.g. under an angle of 10°. Thereby, it is possible to clean the nozzles 19 and the nozzle pipe 17, since these can be emptied completely using compressed air.

Figure 4:
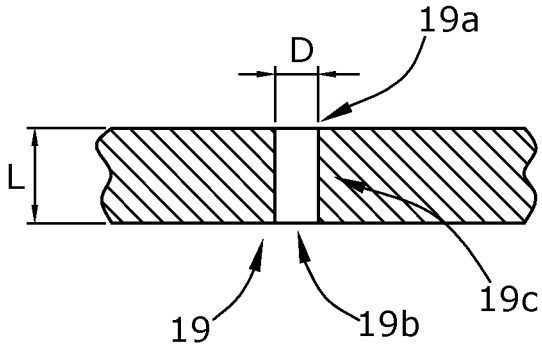
FIG. 4 is a schematical sectional view of a nozzle of a nozzle device of the device according to the present invention.

As best seen in FIG. 4 which schematically illustrates a single nozzle 19 in detail, each nozzle 19 has a nozzle feed line 19*a* with a diameter D. Upstream of the nozzle outlet 19*b*, a straight feed line section 19*c* of the nozzle feed line is provided which has a length L. Here, it holds that $L/D>1.5$. It is achieved thereby that the binder flowing through the nozzle 19 settles and an advantageous liquid jet of binder can leave from the nozzle outlet 19*b*.

When introducing the binder in a direction against the main flow direction of the stream of particles, it may be provided that the binder is introduced at a pressure between 10 and 40 bar. In particular it may be provided that the binder exits from the nozzle device 19 at a velocity of at least 50 m/s, the binder having a viscosity between 30 and 150 mPa·s.

The invention claimed is:

1. A device for the gluing of particles, comprising a dryer and a line transporting the stream of particles, wherein the stream of particles is introduced in a main flow direction into the dryer via the outlet, a binder being supplied to the stream of particles, wherein the binder is introduced via a nozzle device with a velocity component directed against the main flow direction and wherein the nozzle device includes at least one jet-forming nozzle.

2. The device of claim 1, wherein the nozzle device includes three jet-forming nozzles arranged in parallel with each other.

3. The device of claim 1, wherein a nozzle direction of at least one nozzle of the nozzle device is arranged at an angle β with respect to the main flow direction, where $90°<\beta<180°$.

4. The device of claim 1, wherein the nozzle device is arranged downstream of the outlet, seen in the main flow direction.

5. The device of claim 4, wherein the line is arranged horizontally and the at least one nozzle of the nozzle device is oriented onto the sectional line of the horizontal centre plane of the stream of particles with the vertical outlet plane of the outlet of the line or to above this sectional line.

6. The device of claim 1, wherein the nozzle device is arranged at a section of the line located in the dryer upstream of the outlet, seen in the main flow direction.

7. The device of claim 1, wherein each nozzle has a nozzle feed line, the nozzle feed line having a diameter D and, upstream of the nozzle outlet, a straight feed line section with a length L, where: L/D>1.5.

8. A method for gluing particles, in a dryer, comprising: introducing a stream of particles into the dryer in a main flow direction and supplying a binder to the stream of particles, wherein the binder is introduced with a velocity component directed against the main flow direction.

9. The method of claim 8, wherein the binder is introduced into the stream of particles as at least one liquid jet.

10. The method of claim 8, wherein the binder is supplied at a pressure between 5 and 40 bar.

11. The method of claim 8, wherein the binder is introduced at a velocity of at least 50 m/s at a viscosity of the binder between 30 and 150 mPa·s.

* * * * *